US008188940B2

(12) United States Patent
Kim

(10) Patent No.: US 8,188,940 B2
(45) Date of Patent: May 29, 2012

(54) ORGANIC ELECTROLUMINESCENT DISPLAY DEVICE AND METHOD OF DRIVING THE SAME

(75) Inventor: Yang-Wan Kim, Suwon-si (KR)

(73) Assignee: Samsung Mobile Display Co., Ltd, Yongin, Gyunggi-do (KR)

( * ) Notice: Subject to any disclaimer, the term of this patent is extended or adjusted under 35 U.S.C. 154(b) by 1086 days.

(21) Appl. No.: 11/327,708

(22) Filed: Jan. 6, 2006

(65) Prior Publication Data

US 2006/0170625 A1 Aug. 3, 2006

(30) Foreign Application Priority Data

Jan. 7, 2005 (KR) ..... 10-2005-0001486

(51) Int. Cl.
*G09G 3/30* (2006.01)

(52) U.S. Cl. ..... 345/76; 345/77; 345/87; 345/204

(58) Field of Classification Search ..... 345/76–77, 345/80, 82–83, 87, 92, 96, 98, 100, 204, 345/211, 214; 315/169.1, 169.3
See application file for complete search history.

(56) References Cited

U.S. PATENT DOCUMENTS 5,892,493 A * 4/1999 Enami et al. ..... 345/94
6,333,729 B1 * 12/2001 Ha ..... 345/98
6,567,327 B2 * 5/2003 Tsuchi ..... 365/203
6,614,295 B2 * 9/2003 Tsuchi ..... 327/563
6,876,346 B2 * 4/2005 Anzai et al. ..... 345/82
7,324,079 B2 * 1/2008 Tobita ..... 345/100
7,436,384 B2 * 10/2008 An ..... 345/98
7,486,261 B2 * 2/2009 Oh et al. ..... 345/76
7,609,234 B2 * 10/2009 Cho et al. ..... 345/76
2002/0101394 A1 * 8/2002 Anzai ..... 345/76

(Continued)

FOREIGN PATENT DOCUMENTS

CN 1447302 A 10/2003

(Continued)

OTHER PUBLICATIONS

First Office Action for Chinese Application No. 200610008929.4 issued Patent Office of the People's Republic of China on Jul. 11, 2008.

(Continued)

*Primary Examiner* — Richard Hjerpe
*Assistant Examiner* — Mansour M Said
(74) *Attorney, Agent, or Firm* — Knobbe, Martens, Olson & Bear LLP

(57) ABSTRACT

An organic electroluminescent display device and a method of driving the same, which can prevent a voltage drop and ensure a simple layout, are disclosed. In one embodiment, the organic electroluminescent display device includes: i) a display unit including a plurality of pixel circuits, ii) a data driver providing a data signal to the display unit, iii) a scan driver providing a scan signal to the display unit, iv) a first voltage source applying a first power supply voltage, v) a second voltage source applying a second power supply voltage to the display unit, and a switching unit electrically connected between the data driver and the second voltage source, and adapted to output the second power supply voltage to the display unit for a first period of time and output the data signal to the display unit for a second period of time in response to a predetermined control signal.

10 Claims, 7 Drawing Sheets

U.S. PATENT DOCUMENTS

| | | | | |
|---|---|---|---|---|
| 2003/0067424 | A1* | 4/2003 | Akimoto et al. | 345/55 |
| 2003/0112208 | A1 | 6/2003 | Okabe et al. | |
| 2004/0174354 | A1 | 9/2004 | Ono et al. | |
| 2005/0007316 | A1* | 1/2005 | Akimoto et al. | 345/76 |

FOREIGN PATENT DOCUMENTS

| | | | |
|---|---|---|---|
| CN | 1559063 | | 12/2004 |
| CN | 100578588 | C | 1/2010 |
| JP | 2003-066908 | | 3/2003 |
| JP | 2003-223138 | | 8/2003 |
| JP | 2004-133240 | | 4/2004 |
| KR | 2003-0032530 | | 4/2003 |
| KR | 2003-0073116 | | 9/2003 |
| WO | WO 03/077229 | A1 | 9/2003 |

OTHER PUBLICATIONS

Notice to Submit Response by Korean Intellectual Property Office on Jun. 30, 2006.

* cited by examiner

ORGANIC ELECTROLUMINESCENT DISPLAY DEVICE AND METHOD OF DRIVING THE SAME

CROSS-REFERENCE TO RELATED PATENT APPLICATIONS

This application claims the benefit of Korean Patent Application No. 10-2005-0001486, filed on Jan. 7, 2005, in the Korean Intellectual Property Office, the disclosure of which is incorporated herein in its entirety by reference.

BACKGROUND OF THE INVENTION

1. Field of the Invention

The present invention relates to an organic electroluminescent display device and a method of driving the same, and more particularly, to an organic electroluminescent display device which can effectively prevent voltage drop and ensure a simple layout, and a method of driving the organic electroluminescent display device.

2. Description of the Related Technology

FIG. 1 is a block diagram of a conventional organic electroluminescent display device 100. Referring to FIG. 1, the organic electroluminescent display device 100 includes a data driver 110, a scan driver 120, and a display unit 130. The display unit 130 includes a plurality of data signal lines which are arranged in a vertical direction, and a plurality of select signal lines which are arranged in a horizontal direction.

In the display unit 130 of the organic electroluminescent display device 100, pixels are defined in the form of a matrix by the data signal lines and the select signal lines, and pixel circuits are arranged in the pixel region.

The data driver 110 transmits data signals D[1] through D[m] for controlling the luminous intensity through the data signal lines to the display unit 130. The scan driver 120 applies scan signals S[1] through S[n] through the scan signal lines to select a line of pixels constituting the display unit 130. Information on the data signals D[1] through D[m] is transmitted to the line of pixels selected by the scan signals S[1] through S[n]. A first voltage source supplies a constant high power supply voltage VDD to all the pixels of the display unit 130.

FIG. 2 is a circuit diagram of a pixel circuit employed by the conventional organic electroluminescent display device of FIG. 1.

Referring to FIG. 2, the pixel circuit employed by the conventional organic electroluminescent display device includes an organic electroluminescent device (OLED), two transistors (M1, M2), and one capacitor $C_{st}$. One of the two transistors is a switching transistor M1, and the other transistor is a driving transistor M2. The number and interconnection of the transistors and the capacitor of the pixel circuit may be changed according to necessary operations of the electroluminescent display device. The transistors are generally thin film transistors (TFTs).

Referring to FIG. 2, a first electrode of the switching transistor M1 is connected to a data line. When the switching transistor M1 is turned on by a scan signal applied to its gate electrode, a data signal (D[m]) is applied into the pixel circuit due to the switching operation.

The capacitor $C_{st}$ is connected between a first electrode and a gate electrode of the driving transistor M2 to maintain a data voltage applied through the switching transistor M1 for a predetermined period of time. Also, the driving transistor M2 supplies a current corresponding to the voltage between both terminals of the capacitor $C_{st}$ to the OLED.

When the switching transistor M1 is turned on, a data voltage applied through the data line is stored in the capacitor $C_{st}$, and when the switching transistor M1 is turned off later, a current corresponding to the data voltage stored in the capacitor $C_{st}$ is applied to the OLED through the driving transistor M2, so as to emit light.

The current flowing through the OLED is given by the following formula.

$$I_{OLED} = \frac{\beta}{2}(V_{gs} - V_{th})^2 = \frac{\beta}{2}(V_{DD} - V_{data} - |V_{th}|)^2 \quad (1)$$

where $I_{OLED}$ denotes a current flowing in the OLED, $V_{gs}$ denotes a voltage between a gate and a source of the driving transistor M2, $V_{th}$ denotes a threshold voltage of the driving transistor M2, $V_{DD}$ denotes a first power supply voltage, $V_{data}$ denotes a data voltage, and β denotes a gain factor.

Since the conventional organic electroluminescent display device 100 undergoes a voltage drop due to a first voltage line through which the first power supply voltage $V_{DD}$ is applied, the value of the first power supply voltage $V_{DD}$ applied to the plurality of pixels is not constant.

As shown in FIG. 2, the current applied to the OLED is greatly dependent on the magnitude of the first power supply voltage $V_{DD}$. Accordingly, when the first power supply voltage $V_{DD}$ drops, a desired amount of current does not flow through the OLED for each pixel, thereby degrading image quality. The voltage drop problem becomes worse as the size of the display unit 130 increases and brightness increases.

If a separate circuit is installed to solve the image quality degradation due to the voltage drop, an aperture ratio of the panel layout decreases, thereby degrading brightness.

SUMMARY OF CERTAIN INVENTIVE ASPECTS

One aspect of the present invention provides an organic electroluminescent display device which can prevent image quality degradation due to a voltage drop without reducing an aperture ratio.

Another aspect of the present invention provides an organic electroluminescent display device comprising: i) a display unit including a plurality of pixel circuits, ii) a data driver providing a data signal to the display unit, iii) a scan driver providing a scan signal to the display unit, iv) a first voltage source applying a first power supply voltage, v) a second voltage source applying a second power supply voltage to the display unit, and vi) a switching unit electrically connected between the data driver and the second voltage source, and adapted to output the second power supply voltage to the display unit for a first period of time and output the data signal to the display unit for a second period of time in response to a predetermined control signal.

In one embodiment, the switching unit may comprise multiplexers each of which selectively outputs either the data signal or the second power supply voltage to the display unit.

In one embodiment, each of the multiplexers may comprise: a first switching element having one end electrically connected to the data driver, and a second switching element having one end electrically connected to the second voltage source, wherein the other ends of the first and second switching elements are electrically connected to each other to form one output terminal through which either the data signal or the second power supply voltage is selectively output.

In one embodiment, one of the first and second switching elements may be turned on when receiving a high-level control signal, and the remaining one may be turned on when receiving a low-level control signal.

In one embodiment, the high-level control signal and the low-level control signal may be alternately applied to the multiplexer according to a predetermined cycle.

In one embodiment, each of the pixel circuits may comprise: an organic electroluminescent device emitting light in response to an applied current, a first transistor having one electrode connected to the first voltage source, and transmitting a first voltage in response to a first scan signal applied to a gate electrode of the first transistor, a second transistor electrically connected to the switching unit, and transmitting either the data signal or the second power supply voltage in response to a second scan signal applied to a gate electrode of the second transistor, a first capacitor electrically connected between the first transistor and the second transistor, and being charged with a voltage difference between the first power supply voltage transmitted from the first transistor and the second power supply voltage transmitted from the second transistor, and a driving transistor having a gate electrode electrically connected to the first transistor and the first capacitor, and supplying a current to the organic electroluminescent device in response to a voltage between a gate terminal and a source terminal of the driving transistor.

In one embodiment, each of the pixel circuits may further comprise a storage capacitor disposed between the gate electrode of the driving transistor and the first voltage source.

In one embodiment, the first scan signal may turn on the first transistor during the first period of time.

In one embodiment, the second scan signal may turn on the second transistor during the first period of time and the second period of time.

Another aspect of the present invention provides a method of driving an organic electroluminescent display device which comprises a display unit including a plurality of pixel circuits, a data driver inputting a data signal to the display unit, a scan driver inputting a first scan signal and a second scan signal to the display unit, first and second voltage sources respectively applying first and second power supply voltages, and a switching unit selectively outputting either the data signal or the second power supply voltage. In one embodiment, the method comprises: i) simultaneously turning on the first scan signal and the second scan signal to transmit the first power supply voltage and the second power supply voltage, ii) turning off the first scan signal and turning on the second scan signal to transmit the data signal and iii) simultaneously turning off the first scan signal and the second scan signal.

In one embodiment, the simultaneously turning on of the first power supply voltage and the second power supply voltage may comprise the switching unit outputting the second power supply voltage.

In one embodiment, the turning off of the first scan signal and the turning on of the second scan signal may comprise the switching unit outputting the data signal.

BRIEF DESCRIPTION OF THE DRAWINGS

Embodiments of the present invention will be described with reference to the attached drawings.

DETAILED DESCRIPTION OF CERTAIN INVENTIVE EMBODIMENTS

Figure 1:
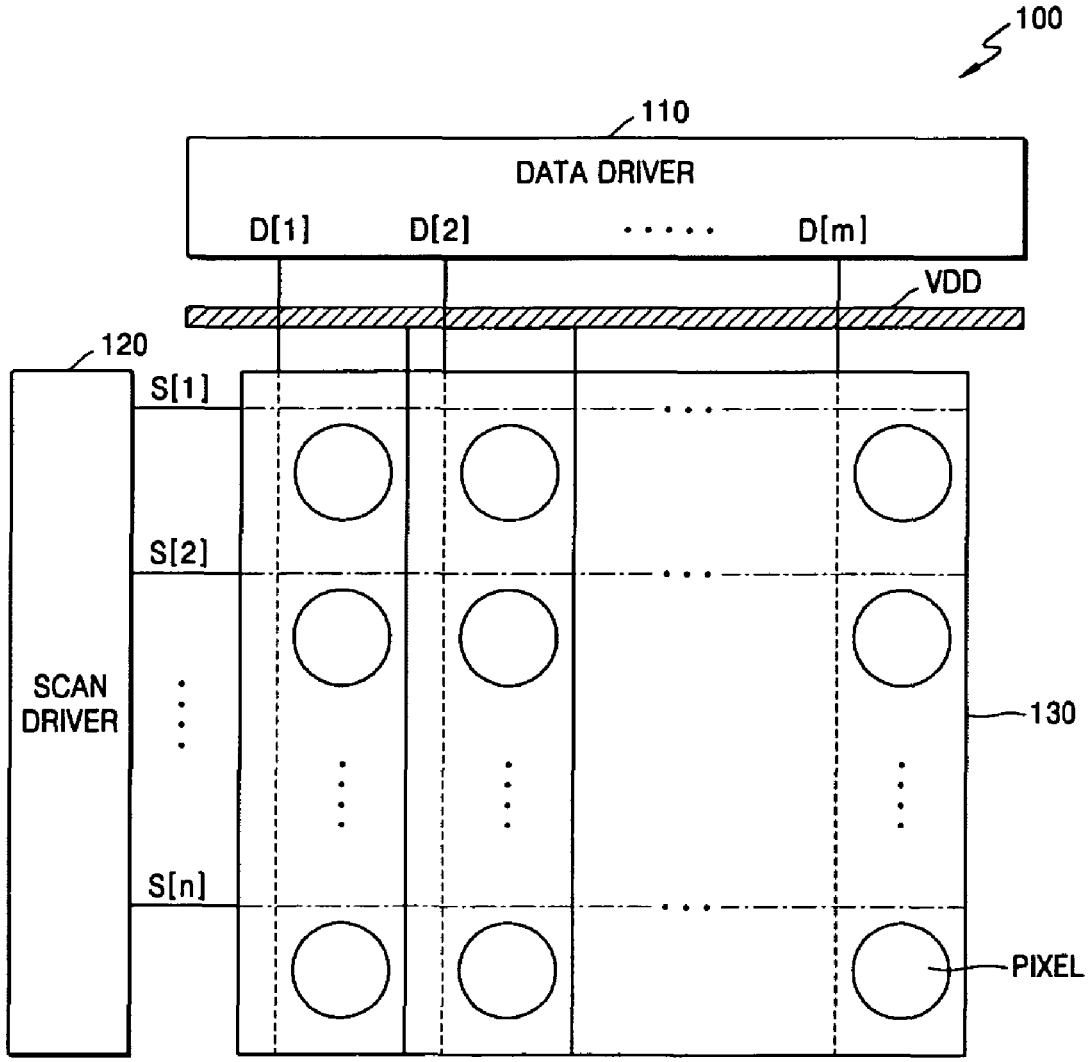
FIG. 1 (PRIOR ART)
FIG. 1 is a block diagram of a conventional organic electroluminescent display device.
Figure 2:
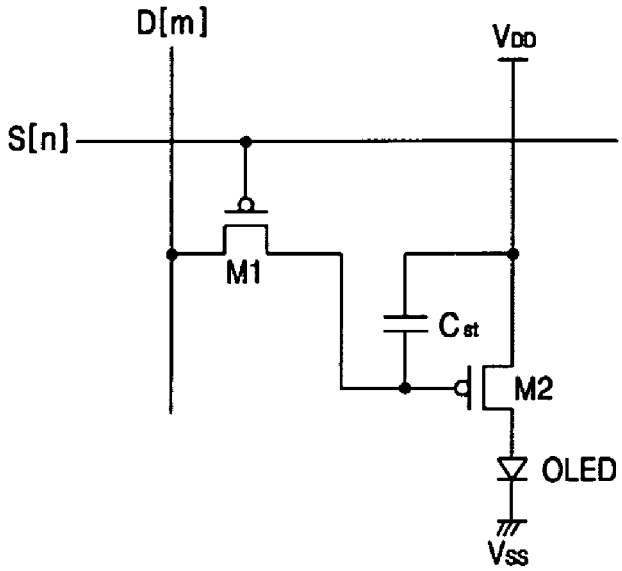
FIG. 2 (PRIOR ART)
FIG. 2 is a circuit diagram of a pixel circuit employed by the conventional organic electroluminescent display device of FIG. 1.

Embodiments of the present invention will now be described more fully with reference to the accompanying drawings, in which preferred embodiments of the invention are shown. The same elements are given the same reference numerals.

Figure 3:
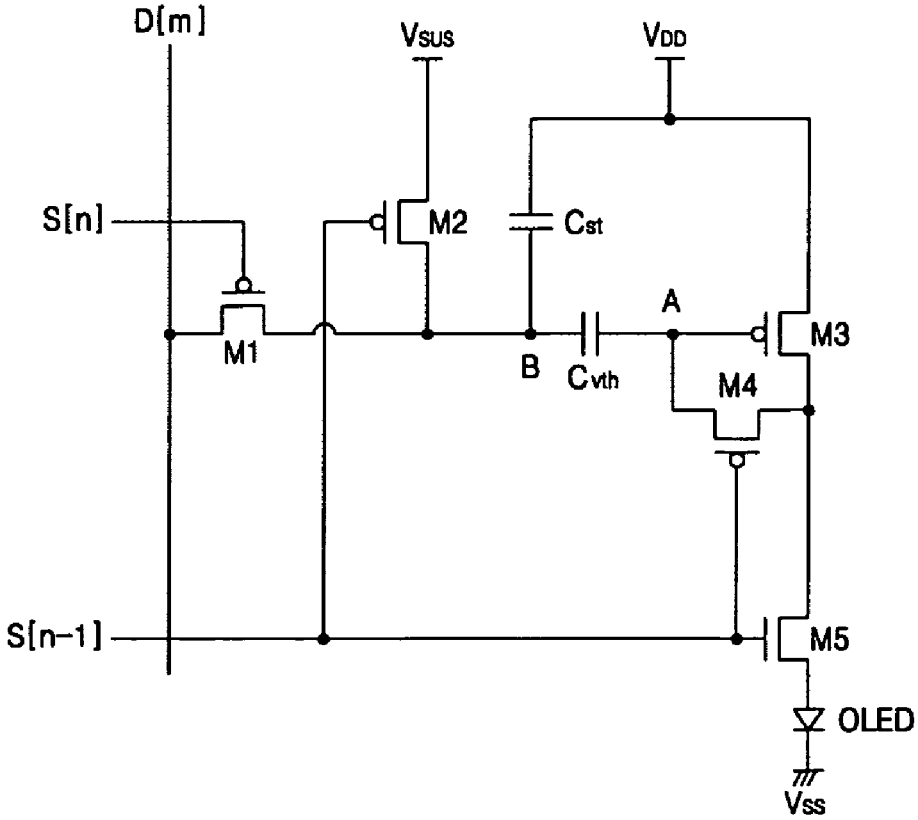
FIG. 3 is a circuit diagram of a pixel circuit which can be employed by an organic electroluminescent display device capable of preventing image quality degradation due to a voltage drop.
Figure 4:
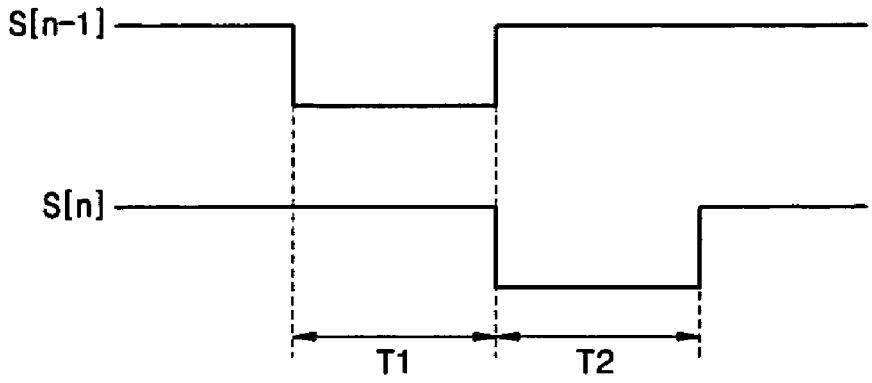
FIG. 4 is a signal diagram illustrating signals for driving the pixel circuit of FIG. 3.
Figure 5:
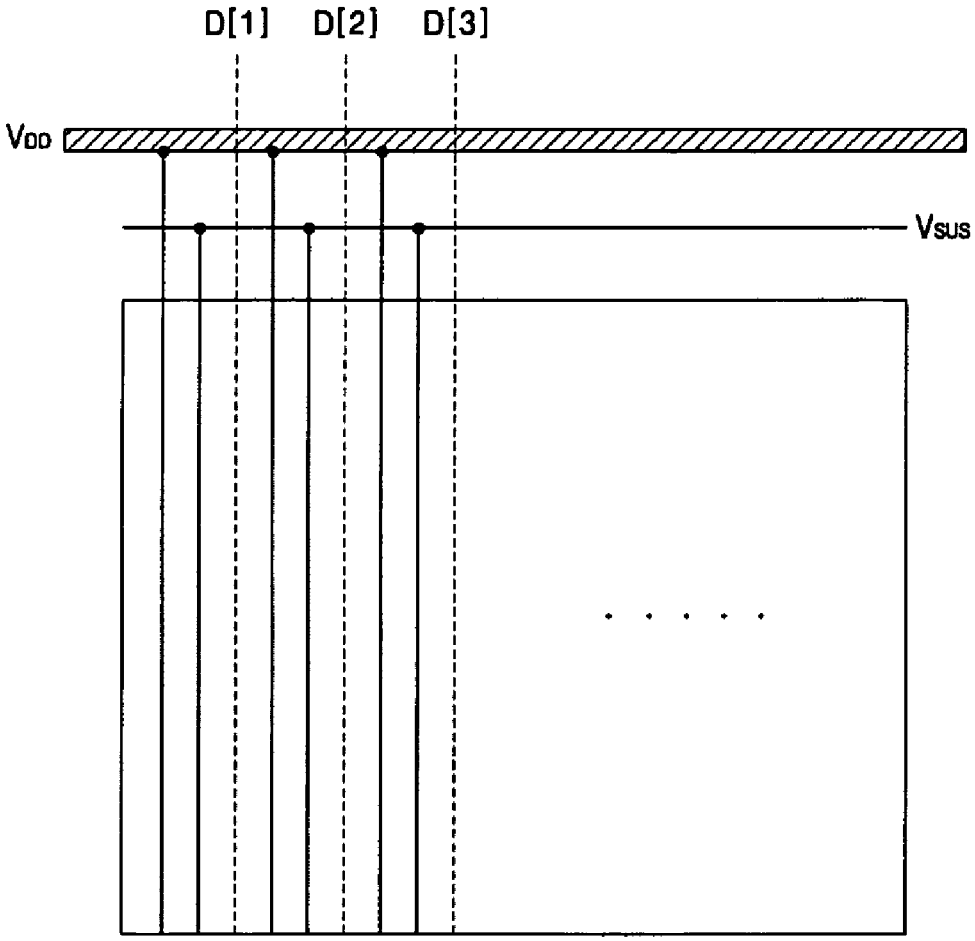
FIG. 5 illustrates an organic electroluminescent display device employing the pixel circuit of FIG. 3.

FIG. 3 is a circuit diagram of a pixel circuit which can be employed by an organic electroluminescent display device capable of preventing image quality degradation due to a voltage drop. FIG. 4 is a signal diagram illustrating signals for driving the pixel circuit of FIG. 3. FIG. 5 illustrates an organic electroluminescent display device employing the pixel circuit of FIG. 3.

Referring to FIG. 3, an $m^{th}$ data signal line and an $n^{th}$ scan signal line are connected to the pixel circuit of a display unit. The pixel circuit includes transistors M1 through M5, capacitors $C_{st}$ and $C_{vth}$, and an organic electroluminescent device (OLED).

A second voltage source applies a second power supply voltage $V_{sus}$ to the pixel circuit to prevent image quality degradation due to a voltage drop.

The first transistor M1 has one electrode electrically connected to a switching unit, and transmits a data signal D[m] to the pixel circuit in response to an $n^{th}$ scan signal S[n] applied to a gate electrode of the first transistor M1.

The second transistor M2 has one electrode electrically connected to the switching unit, and transmits a second power supply voltage $V_{sus}$ to the pixel circuit in response to an $(n-1)^{th}$ scan signal S[n−1] applied to a gate electrode of the second transistor M2.

The third transistor M3, which is a driving transistor for driving the OLED, is connected between a first voltage source and the OLED, and supplies a current to the OLED in response to a voltage applied between a gate terminal and a source terminal. The fourth transistor M4 connects the third transistor M3 as a diode in response to the $(n-1)^{th}$ scan signal S[n−1].

A first end A of the first capacitor $C_{vth}$ is connected to the gate electrode of the third transistor M3, and the second capacitor $C_{st}$ is connected between a second end B of the first capacitor $C_{vth}$ and a power source supplying a first power supply voltage VDD.

The fifth transistor M5 is connected between one electrode of the third transistor M3 and an anode of the OLED, and controls current supply to the OLED in response to the $(n-1)^{th}$ scan signal S[n−1].

The OLED emits light in response to an input current. A voltage $V_{ss}$ connected to a cathode of the OLED generally has a lower level than the first power supply voltage VDD, and may be a ground voltage.

The elements and their interconnection in the pixel circuit configured to prevent image quality degradation due to a drop in the first power supply voltage VDD may be changed. It is obvious that the slightly modified pixel circuit can have the same effects.

FIG. 4 is a signal diagram illustrating signals for driving the pixel circuit of FIG. 3.

Referring to FIG. 4, when the $(n-1)^{th}$ scan signal S[n−1] has a low level in a period of time $T_1$, the fourth transistor M4 is turned on and the third transistor M3 is diode-connected. Accordingly, the voltage between the gate and the source of the third transistor M3 is changed to become a threshold voltage Vth of the third transistor M3. Since the voltage VDD is applied to the source of the third transistor M3, a voltage applied to the first end A of the first capacitor $C_{vth}$ becomes VDD+Vth. Also, the second transistor M2 is turned on, such that the second power supply voltage $V_{sus}$ is applied to the second end B of the first capacitor $C_{vth}$.

Consequently, a voltage corresponding to (VDD+Vth−$V_{sus}$) is charged into both the ends of the first capacitor $C_{vth}$.

When the $n^{th}$ scan signal S[n] has a low level for a period of time $T_2$, the first transistor M1 is turned on. Then, a voltage $V_{data}$ according to a data signal is applied through the first transistor M1 to the second capacitor $C_{st}$.

Since the voltage corresponding to (VDD+Vth−$V_{sus}$) is charged in the first capacitor $C_{vth}$, a voltage between the gate and the source of the third transistor M3 is given by the following formula.

$$V_{gs}(V_g-V_s)=(V_{data}+(VDD+V_{th}-V_{sus}))-VDD=V_{data}+V_{th}-V_{sus} \quad (2)$$

Accordingly, the current flowing through the OLED is obtained as follows by applying Formula 2 to Formula 1.

$$I_{OLED}=\frac{\beta}{2}(V_{data}-V_{sus})^2 \quad (3)$$

Since the current flowing through the OLED is not affected by the first power supply voltage VDD, brightness variation due to the voltage drop in the first power supply voltage VDD can be compensated.

FIG. 5 illustrates a layout of the organic electroluminescent display device with the additional second voltage source. Referring to FIG. 5, since three lines ($V_{DD}$, $V_{SUS}$ and $V_{data}$ lines) are arranged in a vertical direction of a display unit to apply the second power supply voltage $V_{sus}$ into the pixel circuit, an aperture ratio of the layout can be reduced.

Figure 6:
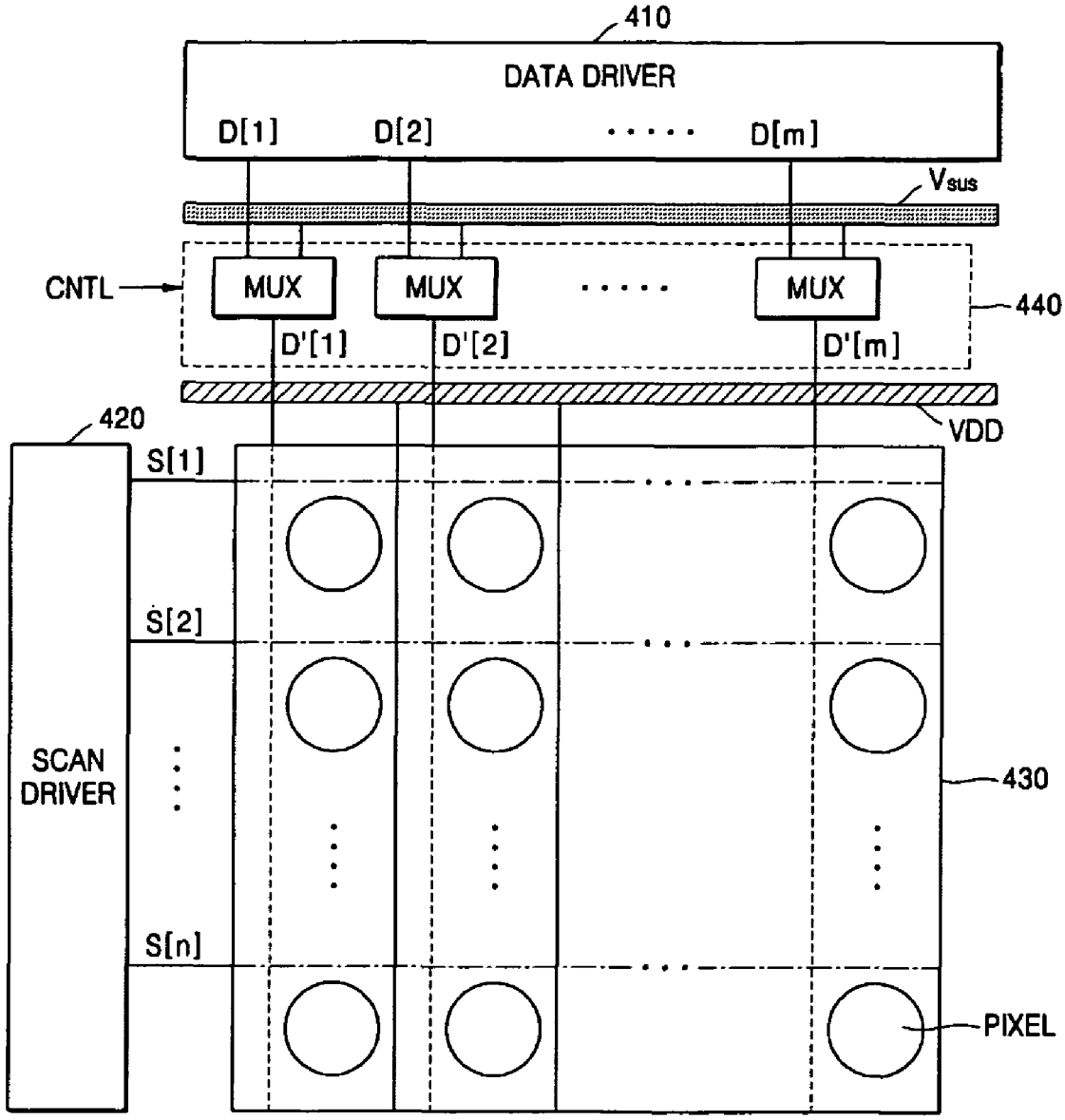
FIG. 6 is a block diagram of an organic electroluminescent display device according to an embodiment of the present invention.

FIG. 6 is a block diagram of an organic electroluminescent display device according to an embodiment of the present invention.

Referring to FIG. 6, the organic electroluminescent display device includes a data driver 410, a scan driver 420, a display unit 430, and a switching unit 440. Also, the organic electroluminescent display device includes a first voltage source (VDD, hereinafter interchangeably used with a first power supply voltage) and a second voltage source ($V_{sus}$, hereinafter interchangeably used with a second power supply voltage) applying a first power supply voltage VDD and a second power supply voltage $V_{sus}$, respectively, to a plurality of pixels constituting the display unit 430.

The data driver 410 is connected to the switching unit 440 via a plurality of data signal lines to output data signals D[1] through D[m]. The plurality of data signals D[1] through D[m] have information regarding light emission of the plurality of pixels constituting the display unit 430.

The scan driver 420 apply scan signals S[1] through S[n] via a plurality of scan lines to select a line of pixels constituting the display unit 430.

The switching unit 440 is connected to the second voltage source supplying the second power supply voltage $V_{sus}$ via a plurality of voltage lines. When a control signal CNTL is applied to the switching unit 440, the switching unit 440 selectively outputs i) the data signals D[1] through D[m]) or the second power supply voltage $V_{sus}$ as signals D'[1] through D'[m]) in response to the control signal CNTL.

In one embodiment, the switching unit 440 outputs the second power supply voltage $V_{sus}$ during a first period of time, and outputs the plurality of data signals D[1] through D[m] during a second period of time.

The switching unit 440 includes a plurality of multiplexers (MUXs) which receive the data signals D[1] through D[m] and the second power supply voltage $V_{sus}$ and selectively output either of them (as D'[1] through D'[m]) through one signal line.

Figure 7:
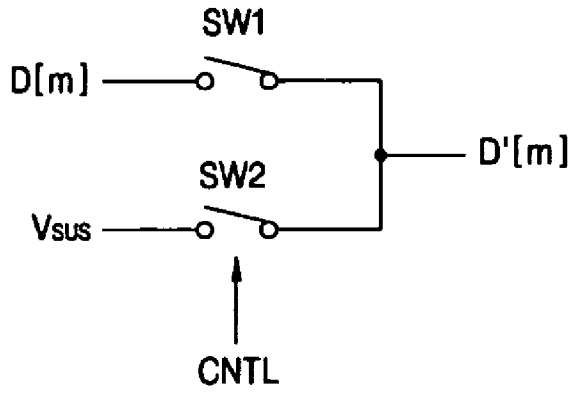
FIG. 7 is a circuit diagram of a multiplexer of the organic electroluminescent display device of FIG. 6.

FIG. 7 is a circuit diagram of a multiplexer of the organic electroluminescent display device of FIG. 6.

In one embodiment, as shown in FIG. 7, the multiplexer MUX includes two switching elements SW1 and SW2 operating according to the level of the control signal CNTL. The control signal CNTL has a high or low level depending on a predetermined cycle.

In one embodiment, one end of the first switching element SW1 is connected to the data driver 410, one end of the second switching element SW2 is connected to the second voltage source, and the other ends of SW1 and SW2 are connected to each other, as shown in FIG. 7.

When the control signal CNTL is applied to the multiplexer MUX to control the first and second switching elements SW1 and SW2, the data signal D[m] (for a mth data) or the second voltage $V_{sus}$ can be selectively output as the signal D'[m] through an output terminal of the multiplexer MUX.

Particularly, the above operation can be performed by alternately turning on the first switching element SW1 and the second switching element SW2. In one embodiment, the first switching element SW1 is turned on when the control signal CNTL is at a high level, and the second switching element SW2 is turned on when the control signal CNTL is at a low level.

In another embodiment, the first and second switching elements SW1 and SW2 can be turned on when the control signal CNTL is at a low level and a high level, respectively, according to interconnection features of the flat panel display device.

In one embodiment, the control signals CNTL of opposite levels are alternately applied to the switching unit 440 according to the predetermined cycle.

Figure 8:
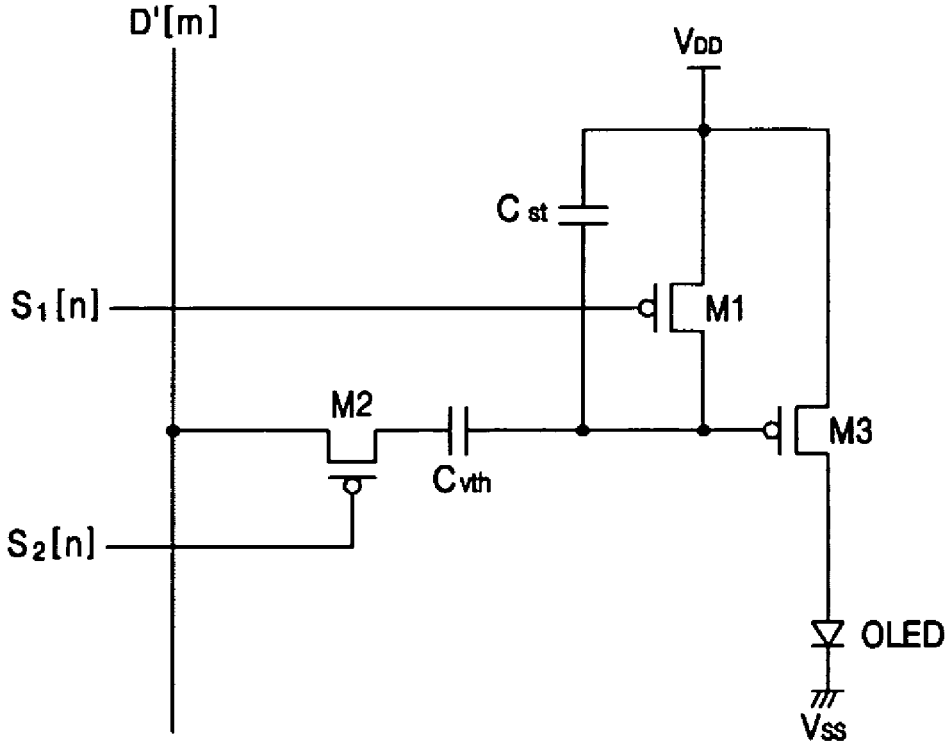
FIG. 8 is a circuit diagram of a pixel circuit employed by the organic electroluminescent display device of FIG. 6.
Figure 9:
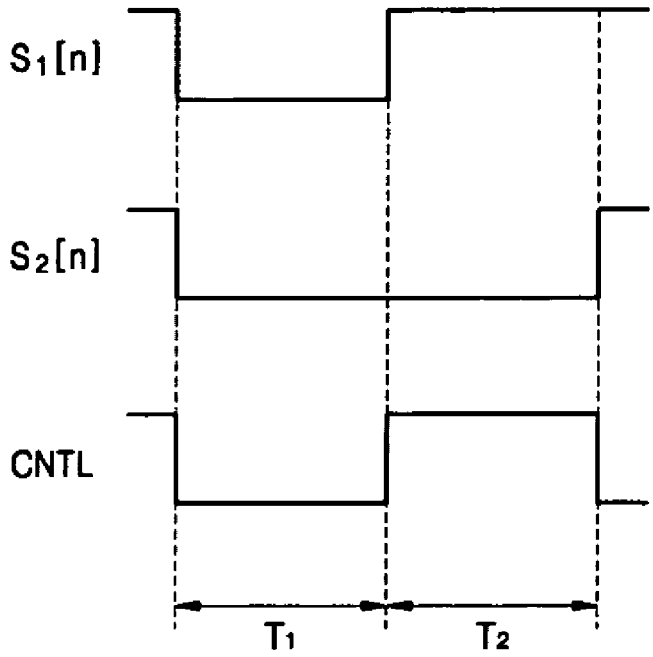
FIG. 9 is a signal diagram illustrating signals for driving the pixel circuit of FIG. 8.

FIG. 8 is a circuit diagram of a pixel circuit employed by the organic electroluminescent display device of FIG. 6. FIG. 9 is a signal diagram illustrating signals for driving the pixel circuit of FIG. 8.

The pixel circuit shown in FIG. 8 is configured such that the data signal D[m] and the second power supply voltage $V_{sus}$ are alternately output as the signal D'[m] to the display unit 430 through one signal line. Elements and interconnection thereof in the pixel circuit can be changed depending on embodiments.

Referring to FIGS. 6 through 12; the pixel circuit of FIG. 8 includes three transistors M1 through M3, two capacitors $C_{st}$ and $C_{vth}$, and an OLED. The pixel circuit of FIG. 8 is driven by a first scan signal $S_1[n]$, a second scan signal $S_2[n]$, and the control signal CNTL. Although FIG. 6 shows that one scan line (S[n]) is connected to one corresponding OLED pixel, it is possible that two scan lines ($S_1[n]$ and $S_2[n]$) are connected to one OLED pixel as shown in FIG. 8.

The first transistor M1 has one electrode electrically connected to the first voltage source and a gate electrode to which the first scan signal $S_1[n]$ is input, and outputs the first power supply voltage VDD in response to the first scan signal $S_1[n]$.

The second transistor M2 has one electrode electrically connected to an output terminal of the switching unit 440 that selectively outputs the data signal D[m] or the second power supply voltage $V_{sus}$. Furthermore, a gate electrode of the second transistor M2 is connected to the second scan signal $S_2[n]$. That is, M2 outputs either $V_{sus}$ or D[m] in response to the second scan signal $S_2[n]$.

The first capacitor $C_{vth}$ is electrically connected between the first transistor M1 and the second transistor M2, and is charged with a voltage difference between the first power supply voltage VDD output from the first transistor M1 and the second power supply voltage $V_{sus}$ output from the second transistor M2.

The third transistor M3, which is a driving transistor for driving the OLED, has a gate electrode electrically connected to the first transistor M1 and the first capacitor $C_{vth}$, one electrode connected to the first voltage source, and the other electrode connected to the OLED. M3 supplies a current to the OLED in response to a voltage between a gate terminal and a source terminal.

The storage capacitor $C_{st}$ is electrically connected between the gate electrode of the third transistor M3 and the first voltage source, and stores a voltage difference between the voltage of the gate electrode of the third transistor M3 and the first power supply voltage VDD.

Referring to FIG. 9, the operation of the pixel circuit of FIG. 8 will be explained.

FIG. 9 is a signal diagram illustrating the signals for driving the pixel circuit of FIG. 8. Referring to FIG. 9, for a first period of time $T_1$, the first scan signal $S_1[n]$ and the second scan signal $S_2[n]$ transit to a low level to be turned on, and the control signal CNTL also transits to a low level.

For a second period of time $T_2$, the first scan signal $S_1[n]$ transits to a high level, and the second scan signal $S_2[n]$ is maintained at the low level, such that the first scan signal $S_1[n]$ is turned off and the second scan signal $S_2[n]$ is maintained the turn on state. The control signal CNTL transits to a high level.

After the second period of time $T_2$, the first scan signal $S_1[n]$ is maintained at the high level, and the second scan signal $S_2[n]$ transits to a high level, such that the first scan signal $S_1[n]$ and the second scan signal $S_2[n]$ are turned off. The control signal CNTL transits to a low level.

The first transistor M1 is turned on by the first scan signal $S_1[n]$ during the first period of time $T_1$ ($S_1[n]$: low level). Thus, the first transistor M1 transmits the first power supply voltage VDD to a first end of the first capacitor $C_{vth}$ and the gate electrode of the third transistor M3. The second transistor M2 is turned on by the scan second signal $S_2[n]$ during the first period of time $T_1$ ($S_2[n]$: low level). Thus, the second transistor M2 transmits either the data signal D[m] or the second power supply voltage $V_{sus}$ output from the switching unit 440 to a second end of the first capacitor $C_{vth}$. If the switching unit 440 outputs $V_{sus}$ during the first period of time (T1) as in FIGS. 10 and 11 (will be described in greater detail later), VDD is applied to the first end of the first capacitor $C_{vth}$ and $V_{sus}$ is applied to the second end of the capacitor $C_{vth}$. Accordingly, during the first period of time (T1), a voltage difference VDD−$V_{sus}$ between the first power supply voltage and the second power supply voltage is charged in the first capacitor $C_{vth}$.

In this situation, since the same power supply voltage VDD is applied to the gate and the source electrodes of the third transistor M3 during the first period of time $T_1$, no current flows through the OLED.

The first transistor M1 is turned off by the first scan signal $S_1[n]$ during the second period of time $T_2$ ($S_1[n]$: high level). Thus, the first transistor M1 does not transmit the first power supply voltage VDD to the first end of the first capacitor $C_{vth}$, that is, to the gate electrode of the third transistor M3. If the switching unit 440 outputs $V_{data}$ (the potential of the data signal D[m]) during the second period of time (T2) as in FIGS. 10 and 11, the second transistor M2 transmits $V_{data}$ to the second end of the first capacitor $C_{vth}$. Thus, the potential of the first end of the first capacitor $C_{vth}$, that is, the gate electrode of the third transistor M3, is given by the following formula, considering the voltage (VDD−$V_{sus}$) which was already charged in the capacitor $C_{vth}$ for the first period of time (T1).

$$VDD+V_{data}-V_{sus} \tag{4}$$

Accordingly, the value of the current flowing through the OLED can be obtained as follows by applying Formula 4 to Formula 1.

$$I_{OLED} = \frac{\beta}{2}(V_{data} - V_{sus} - V_{TH1})^2 \tag{5}$$

In Formula 5, $V_{TH1}$ denotes a threshold voltage of the third transistor M3.

Referring to Formula 5, the current flowing through the OLED is not affected by the first power supply voltage VDD, and accordingly, brightness variation due to a voltage drop in the first power supply voltage VDD can be compensated.

As described above, the pixel circuit according to the present embodiment includes the second voltage source to reduce image quality degradation due to the voltage drop. Also, since a separate power supply line does not need to apply the second power supply voltage $V_{sus}$ to each of the pixels, image quality degradation due to the voltage drop can be reduced without lowering an aperture ratio, thereby improving brightness.

Although not shown in FIG. 8, a transistor can be electrically connected between the gate electrode of the third transistor M3 and the OLED, as shown in FIG. 3, in order to compensate for a variation of the current flowing through the OLED due to a threshold voltage difference of the third transistors for each pixel.

Figure 10:
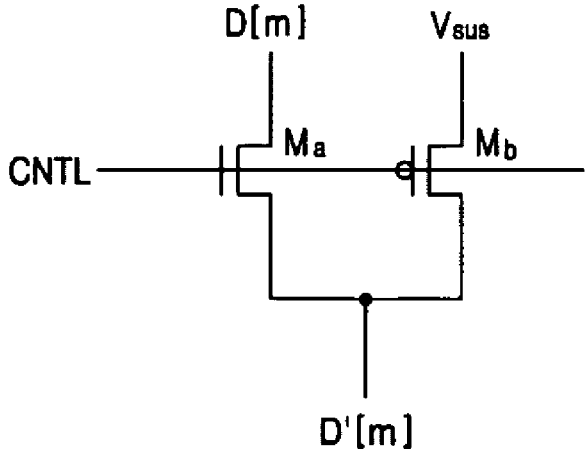
FIG. 10 is a circuit diagram of a multiplexer with different types of transistors.
Figure 11:
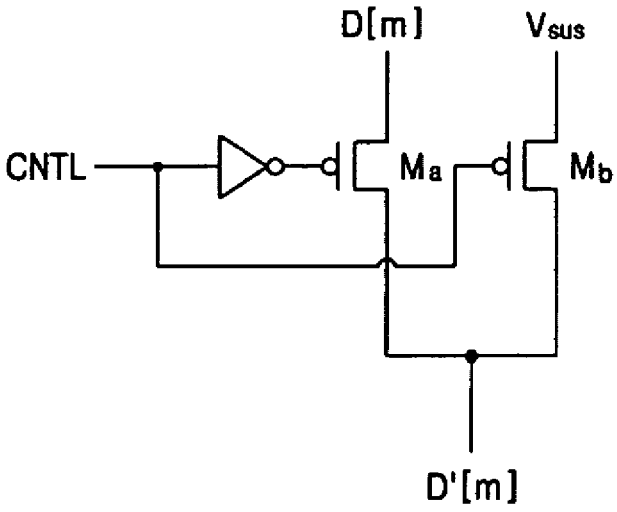
FIG. 11 is a circuit diagram of a multiplexer with the same types of transistors.

FIG. 10 is a circuit diagram of a multiplexer with different types of transistors. FIG. 11 is a circuit diagram of a multiplexer with the same types of transistors.

Referring to FIGS. 10 and 11, each of the multiplexers includes the first switching transistor Ma and the second switching transistor Mb which are alternately turned on and off. In one embodiment, the first switching transistor Ma has a first electrode electrically connected to the data driver 410, and the second switching transistor Mb has a first electrode electrically connected to the second voltage source.

Second electrodes of the first and second switching transistors Ma and Mb are connected to each other.

In one embodiment as shown in FIG. 10, the first switching transistor Ma and the second switching transistor Mb are different types of transistors. When the control signals CNTL of the same phase are applied to gate electrodes of Ma and Mb, the data signal D[m] or the second power supply voltage $V_{sus}$ is selectively output as the signal D'[m] through the output terminal of the multiplexer.

In another embodiment as shown in FIG. 11, the first switching transistor Ma and the second switching transistor Mb are the same types of transistors. When the control signals CNTL of opposite phases are applied to the gate electrodes of Ma and Mb, the data signal D[m] or the second power supply voltage $V_{sus}$ is selectively output as the signal D'[m] through the output terminal of the multiplexer.

In one embodiment, the control signals CNTL of the opposite phases can be simply applied to the first switching transistor Ma and the second switching transistor Mb by applying a control signal obtained by inverting a control signal CNTL to the gate electrode of Ma and the control signal CNTL the gate electrode of Mb.

Figure 12:
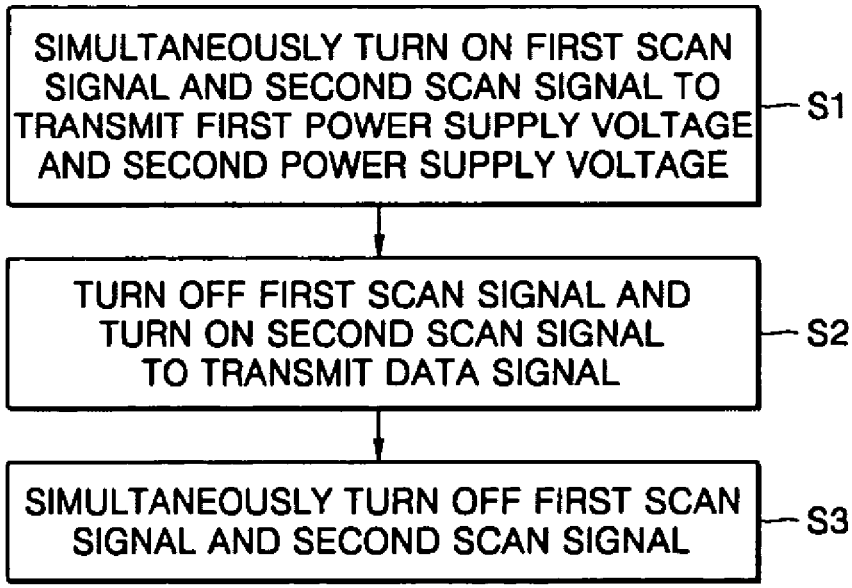
FIG. 12 is a flow chart illustrating a method of driving the organic electroluminescent display device of FIG. 8.

FIG. 12 is a flow chart illustrating the method of driving the organic electroluminescent display device according to one embodiment of the present invention.

Referring to FIGS. 6 through 12, in operation S1, the first scan signal $S_1[n]$ and the second scan signal $S_2[n]$ are simultaneously turned on to transmit the first power supply voltage VDD and the second power supply voltage $V_{sus}$. That is, in operation S1 occurring during the first period of time $T_1$, (see FIG. 11, for example), as discussed above, the first power supply voltage VDD is transmitted to the first end of the first capacitor $C_{vth}$, and the second power supply voltage $V_{sus}$ other than the data signal D[m] is output from the switching unit 440. Also, because the second scan signal $S_2[n]$ is turned on, the second power supply voltage $V_{sus}$ is transmitted to the second end of the first capacitor $C_{vth}$. A voltage difference $V_{DD}-V_{sus}$ between the first power supply voltage and the second power supply voltage is charged in the first capacitor $C_{vth}$.

In operation S2, the first scan signal $S_1[n]$ is turned off and the second scan signal $S_2[n]$ is turned on, such that the data signal D[m] is transmitted. That is, in operation S2 occurring during the second period of time $T_2$ (see FIG. 11, for example), as discussed above, the data signal D[m] is transmitted to the second end of the first capacitor $C_{vth}$. When a potential of the data signal D[m] is $V_{data}$, a potential of the first end of the first capacitor $C_{vth}$ is $VDD-V_{sus}+V_{data}$. Accordingly, a current flows through the OLED.

In operation S3, the first scan signal $S_1[n]$ and the second scan signal $S_2[n]$ are turned off simultaneously. Any one of the first power supply voltage VDD, the second power supply voltage $V_{sus}$, and the data signal D[m] is no longer transmitted to the first transistor M1 and the second transistor M2.

As described above, the organic electroluminescent display device according to one embodiment of the present invention employs the second voltage source to prevent image quality degradation due to a voltage drop. Consequently, a separate power supply line does not need to apply the second power supply voltage $V_{sus}$, thereby preventing brightness deterioration caused by a decrease in an aperture ratio.

While the above description has pointed out novel features of the invention as applied to various embodiments, the skilled person will understand that various omissions, substitutions, and changes in the form and details of the device or process illustrated may be made without departing from the scope of the invention. Therefore, the scope of the invention is defined by the appended claims rather than by the foregoing description. All variations coming within the meaning and range of equivalency of the claims are embraced within their scope.

What is claimed is:

1. An organic electroluminescent display, comprising:

a display unit including a plurality of pixel circuits;

a data driver configured to provide a data signal to the display unit;

a scan driver configured to provide a scan signal to the display unit;

a first voltage source configured to apply a first power supply voltage to the display unit;

a second voltage source configured to apply a second power supply voltage to the display unit, wherein the second power supply voltage is configured to compensate for a brightness variation due to a voltage drop of the first power supply voltage; and a switching unit electrically connected between the data driver and the second voltage source, and adapted to output the second power supply voltage to the display unit for a first period of time and output the data signal to the display unit for a second period of time in response to a predetermined control signal, wherein the second voltage source is directly connected to the switching unit, and wherein the switching unit comprises multiplexers each of which selectively outputs either the data signal or the second power supply voltage to the display unit.

2. The organic electroluminescent display device of claim 1, wherein each of the multiplexers comprises:

a first switching element having one end electrically connected to the data driver; and a second switching element having one end electrically connected to the second voltage source, wherein the other ends of the first and second switching elements are electrically connected to each other to form one output terminal through which either the data signal or the second power supply voltage is selectively output.

3. The organic electroluminescent display device of claim 2, wherein one of the first and second switching elements is turned on in response to a high-level control signal, and the remaining one is turned on in response to a low-level control signal.

4. An organic electroluminescent display, comprising:

a display unit including a plurality of pixel circuits;

a data driver configured to provide a data signal to the display unit;

a scan driver configured to provide a scan signal to the display unit;

a first voltage source configured to apply a first power supply voltage to the display unit;

a second voltage source configured to apply a second power supply voltage to the display unit, wherein the second power supply voltage is configured to compensate for a brightness variation due to a voltage drop of the first power supply voltage; and a switching unit electrically connected between the data driver and the second voltage source, and adapted to output the second power supply voltage to the display unit for a first period of time and output the data signal to the display unit for a second period of time in response to a predetermined control signal, wherein the second voltage source is directly connected to the switching unit, and wherein the switching unit comprises multiplexers each of which selectively outputs either the data signal or the second power supply voltage to the display unit, wherein each of the multiplexers comprises:

a first switching element having one end electrically connected to the data driver; and a second switching element having one end electrically connected to the second voltage source, wherein the other ends of the first and second switching elements are electrically connected to each other to form one output terminal through which either the data signal or the second power supply voltage is selectively output, wherein one of the first and second switching elements is turned on in response to a high-level control signal, and the remaining one is turned on in response to a low-level control signal, and wherein the high-level control signal and the low-level control signal are alternately applied to the multiplexer according to a predetermined cycle.

5. An organic electroluminescent display, comprising:

a display unit including a plurality of pixel circuits;

a data driver configured to provide a data signal to the display unit;

a scan driver configured to provide a scan signal to the display unit;

a first voltage source configured to apply a first power supply voltage to the display unit;

a second voltage source configured to apply a second power supply voltage to the display unit, wherein the second power supply voltage is configured to compensate for a brightness variation due to a voltage drop of the first power supply voltage; and a switching unit electrically connected between the data driver and the second voltage source, and adapted to output the second power supply voltage to the display unit for a first period of time and output the data signal to the display unit for a second period of time in response to a predetermined control signal, wherein the second voltage source is directly connected to the switching unit, and wherein the switching unit comprises multiplexers each of which selectively outputs either the data signal or the second power supply voltage to the display unit, wherein each of the pixel circuits comprises:

an organic electroluminescent device configured to emit light in response to an applied current;

a first transistor having one electrode connected to the first voltage source, and configured to transmit a first voltage in response to a first scan signal applied to a gate electrode of the first transistor;

a second transistor electrically connected to the switching unit, and configured to transmit either the data signal or the second power supply voltage in response to a second scan signal applied to a gate electrode of the second transistor;

a first capacitor electrically connected between the first transistor and the second transistor, and being charged with a voltage difference between the first power supply voltage transmitted from the first transistor and the second power supply voltage transmitted from the second transistor; and a driving transistor having a gate electrode electrically connected to the first transistor and the first capacitor, and configured to supply a current to the organic electroluminescent device in response to a voltage between a gate terminal and a source terminal of the driving transistor.

6. The organic electroluminescent display device of claim 5, wherein each of the pixel circuits further comprises a storage capacitor disposed between the gate electrode of the driving transistor and the first voltage source.

7. The organic electroluminescent display device of claim 5, wherein the first scan signal turns on the first transistor during the first period of time.

8. The organic electroluminescent display device of claim 5, wherein the second scan signal turns on the second transistor during the first period of time and the second period of time.

9. A method of driving an organic electroluminescent display device, the method comprising:

simultaneously turning on a first scan signal and a second scan signal so as to provide a first power supply voltage and a second power supply voltage to a display unit including a plurality of pixels, wherein the simultaneously turning on of the first power supply voltage and the second power supply voltage comprises outputting the second power supply voltage from a switching unit;

turning off the first scan signal and turning on the second scan signal so as to provide a data signal, which controls luminous intensity of each of the pixels, to the display unit, wherein the turning off of the first scan signal and the turning on of the second scan signal comprises outputting the data signal from a switching unit, wherein the second power supply voltage is directly connected to the switching unit, and wherein the switching unit comprises multiplexers each of which selectively outputs either the data signal or the second power supply voltage to the display unit; and substantially simultaneously turning off the first scan signal and the second scan signal, wherein the second power supply voltage is configured to compensate for a brightness variation due to a voltage drop of the first power supply voltage.

10. A method of driving an organic electroluminescent display device, the method comprising:

providing a first power supply voltage and a second power supply voltage to a display unit, including a plurality of pixels, for a first period of time in response to a first control signal;

providing a data signal, which controls luminous intensity of each of the pixels to the display unit for a second period of time in response to a second control signal different from the first control signal; and selectively outputting, at a switching unit, the second power supply voltage or the data signal to the display unit, wherein the second power supply voltage is directly connected to the switching unit, and wherein the switching unit comprises multiplexers each of which selectively outputs either the data signal or the second power supply voltage to the display unit, wherein the second power supply voltage is configured to compensate for a brightness variation due to a voltage drop of the first power supply voltage.

* * * * *